US006995307B2

(12) United States Patent
Britton

(10) Patent No.: US 6,995,307 B2
(45) Date of Patent: Feb. 7, 2006

(54) SELF-PLAYING MUSICAL DEVICE

(75) Inventor: Simon Andrew Britton, New York, NY (US)

(73) Assignee: S&D Consulting International, Ltd., New York, NY (US)

( * ) Notice: Subject to any disclaimer, the term of this patent is extended or adjusted under 35 U.S.C. 154(b) by 301 days.

(21) Appl. No.: 10/610,901

(22) Filed: Jun. 30, 2003

(65) Prior Publication Data

US 2004/0261601 A1 Dec. 30, 2004

(51) Int. Cl.
*G10D 9/00* (2006.01)

(52) U.S. Cl. ..... 84/387 R; 84/600

(58) Field of Classification Search ..... 84/319, 84/600, 387 R

See application file for complete search history.

(56) References Cited

U.S. PATENT DOCUMENTS

| | | | | |
|---|---|---|---|---|
| 4,038,895 A | | 8/1977 | Clement et al. | 84/1.01 |
| 4,771,410 A | * | 9/1988 | Kolibaba et al. | 368/73 |
| 4,915,008 A | * | 4/1990 | Sakashita | 84/658 |
| 5,272,275 A | | 12/1993 | Kunimoto | 84/661 |
| 5,354,947 A | * | 10/1994 | Kunimoto et al. | 84/622 |
| 5,403,966 A | * | 4/1995 | Kawashima et al. | 84/613 |
| 5,438,156 A | | 8/1995 | Masuda et al. | 84/659 |
| 5,668,340 A | | 9/1997 | Hashizume et al. | 84/742 |
| 5,736,662 A | * | 4/1998 | Spector | 84/600 |
| 5,992,985 A | | 11/1999 | Young et al. | 84/742 |
| 6,881,890 B2 | * | 4/2005 | Sakurada | 84/654 |

OTHER PUBLICATIONS

DefenseLINK News: Digitized Bugle Studied for Use at Military Funerals, Gerrry Gilmore, Oct. 24, 2002.*

SKB NEWS: SKB Works with Inventor to Solve U.S. Military Bugler Shortage, 2004.*

* cited by examiner

*Primary Examiner*—Jeffrey W Donels
(74) *Attorney, Agent, or Firm*—Winston & Strawn LLP

(57) ABSTRACT

Apparatus and methods for a self-playing musical device configured to present a realistic music service as part of a musical wind instrument. The device may be fitted inside the sound pipe of a musical instrument to play music. If desired, the device is shaped and configured to fit entirely within the sound pipe of the musical instrument. Digital circuitry may be implemented (e.g., digital storage, digital signal processor, digital amplifier, etc.) may be configured to play at least one musical song. The device may be suitable for indoor or outdoor performances.

17 Claims, 5 Drawing Sheets

SELF-PLAYING MUSICAL DEVICE

BACKGROUND OF THE INVENTION

The present invention is generally related to musical instruments and, more particularly to self-playing musical devices.

Musical wind instruments such as brass wind instruments deliver rich high quality musical audio for listeners in live settings. In some circumstances, their physical presence may also enhance the richness of the audio-visual experience of the audience. For example, in the context of military burial and memorial services, the presence of a bugler as part of the ceremony has a symbolic effect. Such ceremonies, under U.S. laws in fact, require the playing of Taps as part of the burial or memorial services for U.S. Military Veterans. United States, military veterans are entitled under the laws of the United States to a two-man honor guard at his or her funeral, the folding and presenting of a United States flag, and the playing of Taps. In some circumstances, it may be beneficial to have a technique that is an alternative to the presence of a bugler available for the ceremonies. The use of a "boom box" to play taps has been contemplated for use in place of a bugler at some military burial services when for example a bugler is not available for the ceremony. This technique takes away from the respect and honor that is intended for the veteran and his or her friends and family at the ceremony.

Other known techniques have also been found to be inadequate in achieving audio-visual and environmental effects that are desired for such live musical presentations.

SUMMARY OF THE INVENTION

In accordance with the principles of the present invention, a self-playing musical device may be provided. A self-playing musical device may be configured to be securely received by a musical wind instrument. The device may be adapted to be received by a sound pipe in a musical wind instrument. The device may be configured to simulate the instrument played live. The combination of the device and the instrument may provide a suitable alternative to the play of the instrument by a skilled musician.

The self-playing device may include a speaker, circuitry, a power supply, and a housing. The housing may be adapted to be received by a sound pipe of a musical instrument such as a bugle. The housing may be adapted to be removed from the sound pipe by for example pulling the housing (and therefore, the device) out of the sound pipe. The power supply may be provide power to the device via batteries such as conventional 9 Volt batteries.

Circuitry may, for the most part, be digital circuitry that generate an analog audio signal for the speaker. If desired, analog or combination analog-digital implementations may also be used. If desired, an external speaker may play the music through a wired or wireless connection with the device circuitry. The circuitry may for example include memory circuitry, digital signal processor circuitry, digital amplifier circuitry, micro-controller circuitry, power control circuitry, play-button circuitry, volume-control circuitry, play-indicator circuitry, power supply circuitry and power-indication circuitry. One or more songs (e.g., a single song) may be stored in the memory circuitry in digital form (e.g., in high quality digital form). If desired, memory may be located externally. When the device is powered and a user has selected to play the device, the content of the memory circuitry may be passed (e.g., through streaming data signals) to the digital signal processor to, for example, decode the signals from the memory circuitry.

The digital signal processor circuitry may be configured to be responsive to the play-button circuitry and the micro-controller circuitry. The power supply circuitry and the power control circuitry may be the source of power for the device circuitry. The digital signal processor circuitry may operate on the signals from the memory circuitry and may pass (e.g., stream) the resultant to the digital amplifiers circuitry for amplification and delivery of an analog signal to the speaker. The micro-controller 42 may coordinate and/or control the operation of the device. Features such as indicators for power and play may be included in the device. Control over the volume of the device may also be provided.

The housing may be conic shaped and may have dimensions that are proportional to the interior of a sound pipe of a certain musical wind instrument. Two rubber rings forming two separated ribs on the conic shape of the housing may be used to place the device in a fixed position with respect to the sound pipe. Different configuration in placing the device and the sound pipe in a fixed position with respect to each other may also be employed. If desired, a battery case may be provided that has a lid on the side of the housing and which can be conveniently be flipped open to replace the batteries. A speaker, indicators, a handle, lip for holding the handle, and a power switch may be located on a front face of the device.

BRIEF DESCRIPTION OF THE DRAWINGS

Further features of the inventions, its nature and various advantages will be more apparent from the following detailed description, taken in conjunction with the accompanying drawings in which like reference characters refer to like ports throughout, and in which . . .

DETAILED DESCRIPTION

A musical wind instrument may be modified with the insert of a music-playing device in a sound pipe of the wind instrument that is configured to automatically play music in place of an operator of the instrument. The device when inserted in the instrument and played may, have the effect of leaving audience members with a sufficiently realistic representation of a live performance.

Figure 1:
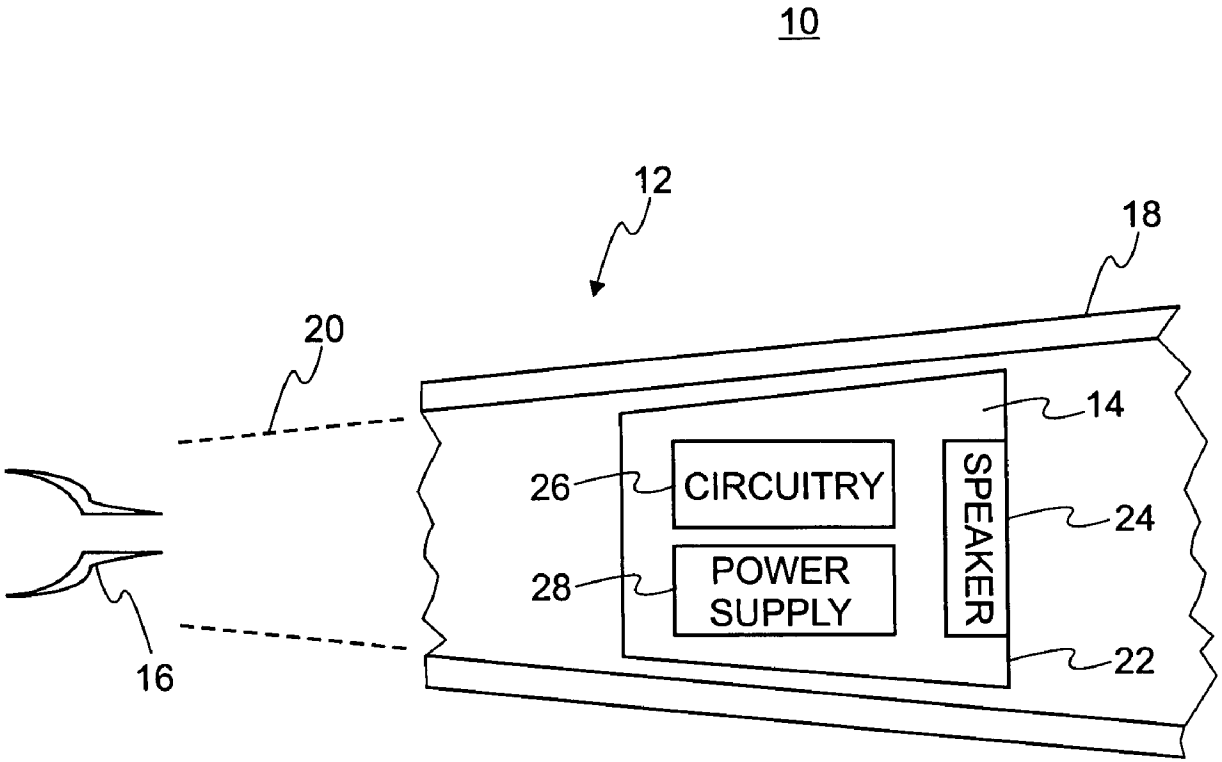
FIG. 1 is a diagram of a cross-sectional view of an illustrative self-playing musical instrument in accordance with one embodiment of the present invention.

The device may be for use in a bugle or other musical wind instrument. The device may be configured to play music such as a rendition of Taps for use at a military burial or memorial ceremony. With references now to FIG. 1, self-playing musical wind instrument 10 may include musical wind instrument 12 and music-generating device 14. Instrument 12 may be a bugle or other musical wind instrument such as a saxophone, a trumpet, a tuba, etc. For clarity and convenience, instrument 12 is illustrated in a generic way in which certain common parts of wind instruments are generally identified. Instrument 12 may include mouth piece 16 with which an operator can generate wind pressure to play instrument 12, sound pipe 18 through which sound generated by instrument 12 emanates, and body portion 20 that connects mouth piece 16 to sound pipe 18. Other portions of instrument 12 that are not explicitly illustrated are know to those skilled in the art.

Music-playing device 14 may include housing 22, speaker 24, circuitry 26, and power supply 28. Music-playing device 14 is shown for the most part in functional blocks. Housing 22 may have structure or shape that is adapted to receive instrument 12 within sound pipe 18. The structure or shape may further be one that is adapted to be removeably received in sound pipe 18 and further one that is securely held by sound pipe 18. Thus, if desired, a user may slide device 14 into sound pipe 18 to put device 14 in a fixed relationship with respect to sound pipe 18. Housing 22 may have a tubular or conic shape that substantially follows the tubular or conic shape of the inner part of sound pipe 18. If desired, housing 22 may have be shaped to substantially block the flow of air through sound pipe 18. If desired, device 14 may be held in place using other techniques such as with screws. If desired, device 14 may be configured for indoor and/or outdoor operation (e.g., an outdoor speaker may be used, water-resistant housing, etc.). Musical wind instrument may be a conventional operable "full-scale" musical wind instrument. Circuitry 26, power supply 28, and speaker 24 may be arranged to play music that is digitally stored. Power supply 28 may power circuitry 26 and speaker 24 to play the music via speaker 24. Circuitry 26 may include storage for storing music. The music, may for example, be stored in digital form.

Figure 2:
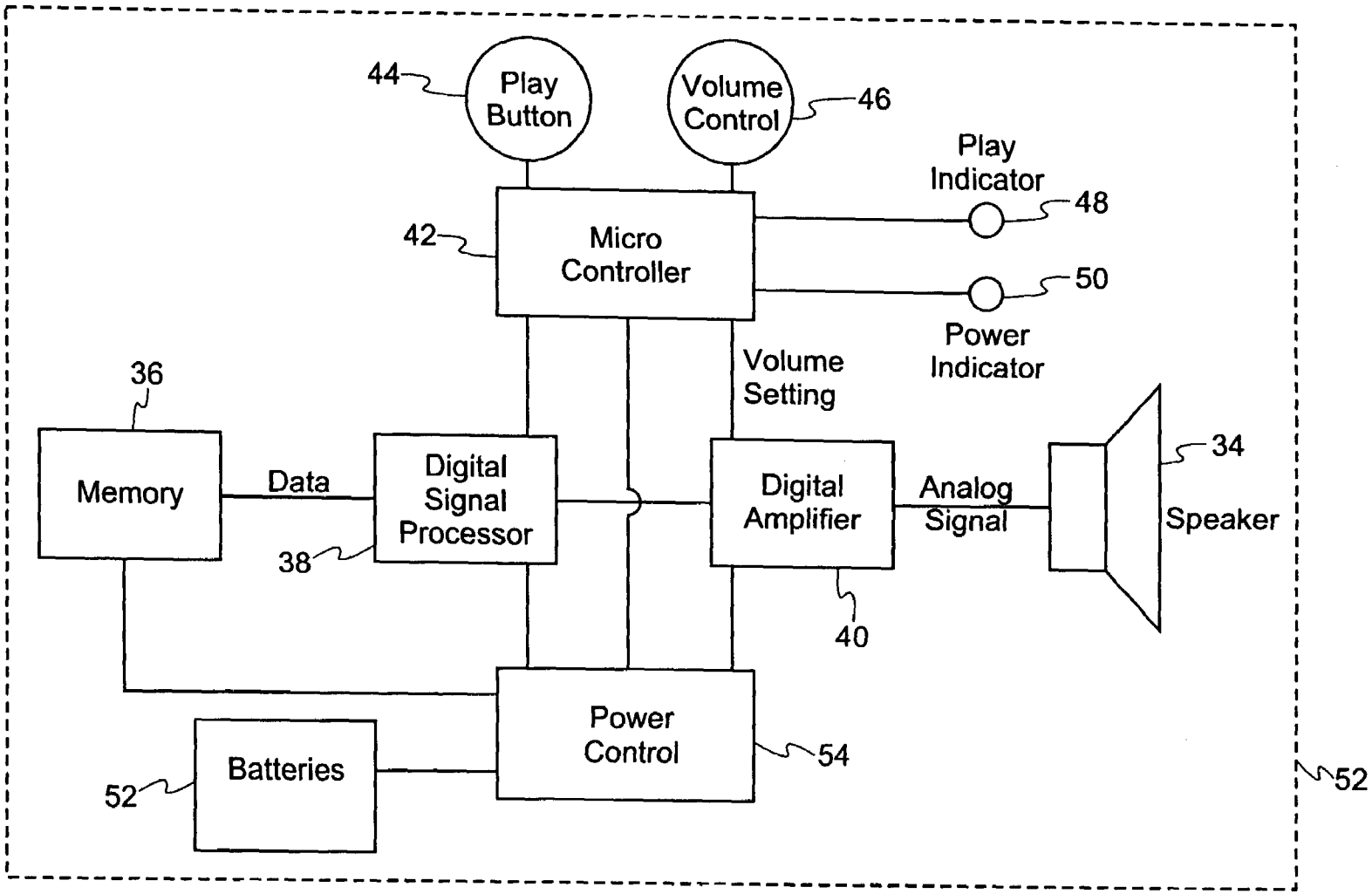
FIG. 2 is a functional block diagram of an illustrative systems for implementing a self-playing musical instrument in accordance with one embodiment of the present invention.

One embodiment of device 14 is illustratively shown in FIG. 2. With reference now to FIG. 2, music-playing device 30 may include housing 32, speaker 34, memory circuitry 36, digital signal process or circuitry 38, digital amplifier circuitry 40, micro-controller circuitry 42, play button circuitry 44, volume control circuitry 46, play indicator circuitry 48, power indicator circuitry 50, power supply circuitry 52 and power control circuitry 54.

Music-playing device 30 may be configured to play music and is configured to fit within sound pipe. Housing 32 may be the same as housing 22 of FIG. 1. Speaker 34 may be associated with housing 32 and more specifically, may be held by or mounted on to housing 34. If desired, speaker 34 may be remotely located from housing 32 and may have a wireless or wired connection with circuitry in housing 32 for playing music.

In operation, desired music may be stored in memory circuitry 36. Memory circuitry 36 may hold at least one song (e.g., Taps). Memory circuitry 36 may for example be nonvolatible memory circuitry that can be programmed to digitally store music. Memory circuitry 36 may be an integrated circuit. If desired, the music may be stored in compressed format. If desired, the storage space should be sufficient to store high quality rendition of the music (e.g., a single song or a set of songs in high quality form). Memory circuitry 36 may be an EPROM or other storage device. Data stored in memory circuitry 36 may be for permanent storage so that a user is not given access to change what is stored therein.

Digital signal processor circuitry 38 may receive signals from memory circuitry 36. The signals may be a stream of signals that are representative of music. The signals may carry music in compressed format. The signals may be in digital form. Digital signal processor circuitry 38 may operate on the signals from memory circuitry 36. Digital signal processor circuitry 38 may operate on the signals to, for example, decode or decompress the data carried by the signals. Digital signal processor circuitry 38 may for example be or include a codec such as the HASC-CD sold by Cybernetics Infotech Inc. of Rockville, Md., which provides a 10 to 1 compression rate. Other codes known to those skilled in the art may also be used. Digital amplifier 40 may receive output from digital signal processor circuitry 38. The output from DSP circuitry 38 may be in digital form. Digital amplifier circuitry 40 may convert and amplify the digital output from DSP circuitry 38 to an analog audio signal for delivery to speaker 34. Digital amplifier circuitry 40 may include digital-to-analog converter circuitry and amplification circuitry to amplify analog signals to levels suitable for speaker 34. If desired, the circuitry may be arranged to use an analog amplifier to amplify analog signals. However, this may cause issues with heat generated by the analog amplifier. The DDX-2100 manufactured by Apogee DDX of Norwood Mass. may for example be used in implementing digital amplifier circuitry 40. Other digital amplifier circuitry known to those skilled in the art may also be used.

Micro-controller circuitry 42 may have an operable connection with DSP circuitry 38 and with digital amplifier. Micro-controller circuitry 42 may control the operation of music-playing device 30 micro-controller circuitry 42 may control DSP circuitry 38 to deliver signals to digital amplifier circuitry 40. Micro-controller circuitry 42 may control a volume setting of digital amplifier circuitry 40 (e.g., micro-controller circuitry 42 may apply a signal to digital amplifier circuitry 40 to control the volume of audio generated by speaker 34).

Micro-controller circuitry 42 may have an operable connection with play button circuitry 44 (e.g., a switch) that a user may trigger to indicate a desire to play the music stored in memory circuitry 36. In response to the play button circuitry 44 being triggered, micro-controller circuitry 42 may operate DSP circuitry 38 and digital amplifier circuitry 40 to play the digitally stored music. Micro-controller circuitry may include delay circuitry that is configured to delay music-playing device 30 from playing for a certain period of time such as a period of time that is sufficient to allow the current operator to position a musical instrument in a way that it appears that the operator is playing the instrument (e.g., a delay of about 5 seconds). Micro-controller circuitry 42 may be operably connected to volume control circuitry 46 that permits the user to set the volume of music-playing device 30. In response to a user setting the volume using volume control circuitry 46, micro-controller circuitry 42 may appropriately control the amplification setting of digital amplifier circuitry 40.

Micro-controller circuitry 42 may be operably connected to play indicator circuitry 48 which may be an LED. Play indicator circuitry 48 may provide an audio or visual indicator indicating that music is playing or is about to be played. Play indicator circuitry 48 may be under the control of micro-controller circuitry 42.

Micro-controller circuitry 42 may have an operable connection with power indicator circuitry 50. Power indicator circuitry 50 may for example be an LED. Power indicator circuitry 50 may provide an audio or visual indicator that music-playing device 30 is powered. Power indicator circuitry 50 may be under the control of micro-controller circuitry 42.

Power may be distributed to components of music-playing device 30 by power controller circuitry 54. Power controller circuitry 54 may have connections for supplying power to memory circuitry 36, DSP circuitry 38, digital amplifier circuitry 40, and micro-controller circuitry 42. If desired, micro-controller circuitry 42 may have an output signal that powers play indicator circuitry 48 and power indicator circuitry 50. Power controller circuitry 54 may receive power from power supply circuitry which may include circuitry for receiving batteries, which may conveniently be standard non-rechargeable batteries (e.g., 9 Volt batteries). A power activation switch may also be included as part of music-playing device 30. If desired, device 30 may be configured to be dedicated to playing one particular song (e.g., Taps). Thus, in some instances, the ability to change which song is played is not given to a user. As such, circuitry in device 30 may be streamlined, simplified, or arranged to taken advantage of this limited range of service.

For example, memory circuitry 36 may store a song in a format that does not conform to a published standard for digital storage of music. This may allow the music to be stored with greater granularity that what may be available in standard formats. Another approach would be to store the music in a format that is specifically configured to be understood by the particular DSP circuitry that is employed in DSP circuitry 38 (e.g., a specific unencoder). This should allow the design to be centered around a DSP that has been found to have desired performance characteristics without having to address whether the format of the digitally captured music is readily compatible with DSP circuitry 38. This allows the digital capture of the song to match the DSP circuitry.

Thus, digitally stored music may be played in a convenient, efficient, and high quality manner from a housing that can fit in a sound pipe of a musical instrument.

Depending on the circumstances, the audio frequency range and the audio volume at which music-playing device 30 may deliver audio may be important. Music-playing device 30, i.e., components of device 30, may be configured to play audio for example in a frequency range of about 2 Kilo Hz to 20,000 Kilo Hz. That is speaker 34 may be capable of normally playing in a range that includes some low-end frequencies that are not often available in smaller size speakers. In turn, data that is stored and operated by components of device 30 may be configured to deliver analog audio signals in that range to speaker 34. Audio volume may also be key in that if a sufficiently realistic simulation of a wind instrument is desired, the stand alone device 30 may need to generate music volume sufficiently close to the volume and range that is available through the type of music instrument associated with device 30. In addition, it may be desirable for the shape and fit of device 30 to be of a nature that it hides device 30 as much as possible when it is inserted into a musical instrument. Thus, the size and shape of device 30 may be sufficiently small to accommodate this. If desired, device 30 may be black in color. Micro controller circuitry 42, memory circuitry 36, DSP circuitry 38, and digital amplified circuitry 40, may include or be semiconductor integrated circuits.

Figure 3:
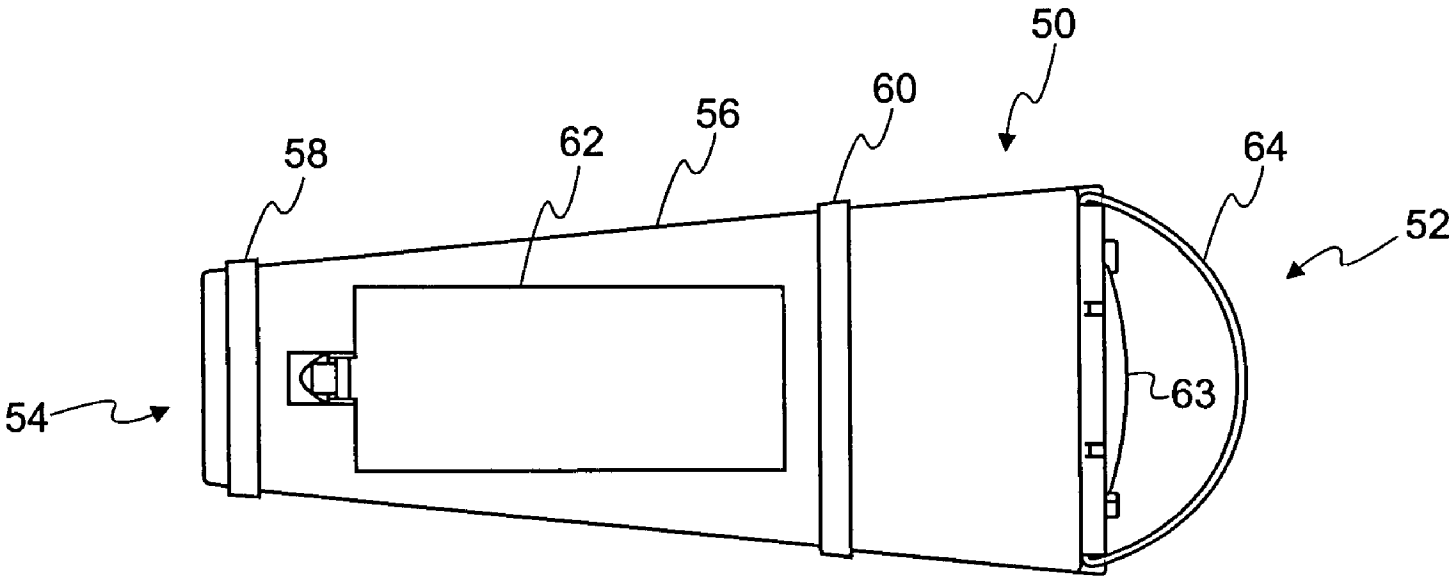
FIGS. 3–5 are a diagrams of an illustrative housing for the illustrative system of FIG. 2 in accordance with one embodiment of the present invention.
Figure 4:
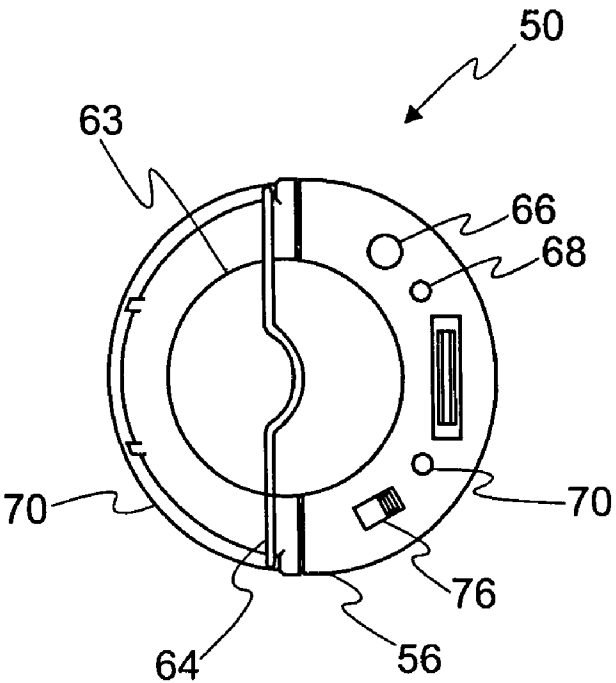
Figure 5:
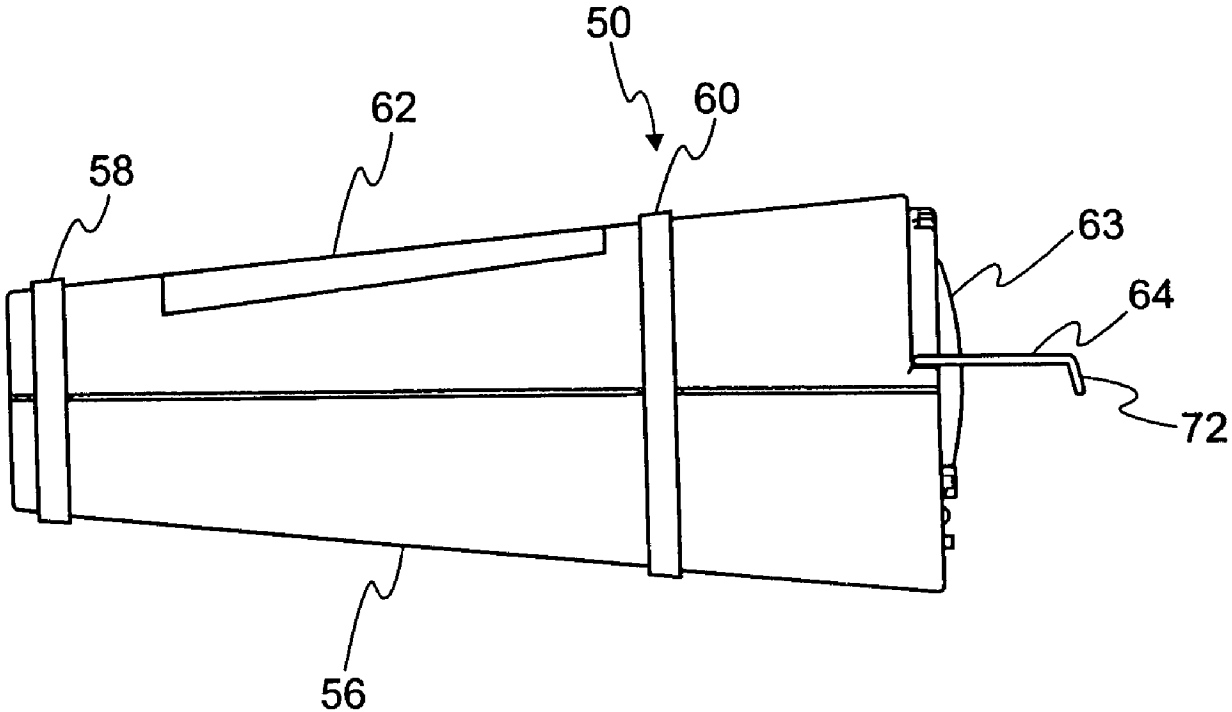

FIGS. 3–5 illustrate an embodiment of a music-playing device 50 may include front face 52 and rear face 54. Rear face 54 of device 50 may be inserted first inserted in a sound pipe of an instrument when device 50 is being positioned in an instrument. Device 50 may include tubular body 56 which is conic shaped so as to be received by the shape of a sound pipe. Device 50 may include first and second rings 58 and 60, which may be rubber rings for holding device 50 in place against an interior wall of a sound pipe of a musical instrument. Device 56 may include battery case 62 which may include a cover that has a lip for conveniently opening battery case 62. Circuitry and components for playing music may be enclosed in tubular body 56 between front and rear faces 52 and 54 of device 50.

Device 50 may include speaker 63 on front face 52, play indicator 68, power indicator 70, power switch 76, and volume control 66 may also be located on front face 52 of device 50. Play indicator 68 may light to indicate that music is playing or is about to play. Power indicator 70 may light to indicate that device 50 is powered. Power indicator 70 may be responsive to power switch 76 with which a user may turn on device 50.

Device 50 may include handle 64 that is attached to front face 52. Handle 64 may be rotated to a position that allows a user to use handle 64 to remove (e.g., pull) device 50 from a sound pipe of an instrument. Device 50 may include lip 70 that is adapted to receive and hold handle 64 stationary when handle 64 is rotated to that position. Handle 64 may include lip 72, which may be positioned half-way along handle 64 for use, for example, in pulling handle 64 from lip 70. If desired, handle 64 and device 50 may be adapted to prevent handle 64 from being in contact with the surface of sound pipe in which device 50 is inserted for operation. Speaker 63 may be located off-center on front face 52 to for example make sufficient room for lip 70, switch 76, power indicator 70, play indicator 68, and/or volume control 66. The dimensions of device 50 may for example be about 150 mm in length, 35 mm in width (narrow end), and 65 mm in width (wide end). The front face of speaker 63 may for example have a diameter of 39 mm. Other configurations for a music-playing device may also be employed.

If desired, a receiver for wireless transmissions may be included as part of the self-playing musical device. For example, data such as music or control commands may be wirelessly transmitted to the self-playing musical device. An external memory device and transmitted may be used in transmitting the data. The self-playing musical device may act on the data that is received (e.g., play music if the transmitted data is music, store transmitted data such as portions or the entirety of a song, etc.) If desired, information contained in memory internal to the music playing device may be updated wirelessly. In some instances, if desired, a wireless receiver internal to the music playing device may be used to replace the memory (mentioned above) to wirelessly receive audio data. Such wireless techniques may for example be provided to implement real time play of audio.

If desired, more than a single control button (e.g., a play button) may be provided for the self-playing musical device. For example, typical controls for controlling the play of audio recordings (e.g., rewind, forward, pause, etc.) may be implemented (e.g. implemented on the speaker end of the self-playing musical device). If desired, control may be provided to the user to select different songs if such a multi-song functionality feature is supported by the self-playing musical device.

Although digital electronics are primarily described herein, analog electronics or a combination of analog and digital electronics may be implemented to provide functionality described herein.

Certain embodiments for particular features of the self-playing musical device and related features are illustratively shown herein. However, the self-playing musical device and/or related features should not be considered to be limited to these certain embodiments.

Thus, a musical wind instrument may be adapted to be a self-playing instrument for use in events such as military funeral or memorial services or other appropriate events.

It is to be understood that the invention is not to be limited to the exact configuration as illustrated and described herein. Accordingly, all expedient modifications readily attainable by one of ordinary skill in the art from the disclosure set forth herein, or by routine experimentation there from, are deemed to be within the spirit and scope of the invention as defined by the appended claims.

What is claimed is:

1. A device for playing music in a musical wind instrument, comprising a housing that is configured and adapted to be removably received within and held securely by a sound pipe of a wind instrument;

a speaker that is associated with the housing circuitry enclosed in the housing that is configured to store music and to play the music using the speaker for those nearby who would be potential listeners of the musical wind instrument; and a power supply enclosed in the housing that powers the circuitry and the speaker to play the music;

wherein music played by the speaker is emitted from the sound pipe of the instrument so that a person holding the instrument while the speaker is playing the music can provide an appearance of playing the instrument.

2. The device of claim 1 further comprising a volume control that is adjustable to set an audio level for playing the music.

3. The device of claim 1 further comprising an indicator that warns that the music is about to play.

4. The device of claim 1 wherein the circuitry comprises a switch that a user triggers to select to have the music played and comprises delay circuitry that is configured to delay playing the music to allow the person to position the wind instrument in an operative playing position before the music plays so as to properly present the appearance of the person playing the instrument.

5. The device of claim 1 further comprising a handle that is attached to a front face of the housing from which the music emanates when played.

6. The device of claim 5 wherein the device is configured with the speaker off-centered to make room for the handle on a face of the housing where the speaker is located.

7. The device of claim 1 wherein the power supply is adapted to receive batteries.

8. The device of claim 1 wherein the housing comprises an exterior rubber ring to engage an inner portion of the sound pipe of the wind instrument.

9. The device of claim 1 wherein the circuitry comprises a digital amplifier that generates an analog signal from digital audio.

10. The device of claim 1 wherein the circuitry comprises a digital signal processor that is configured to received the stored music in compressed form and configured to generate digital audio from the stored music.

11. The device of claim 1 wherein the circuitry comprises nonvolatile memory for storing the music.

12. The device of claim 1 wherein the circuitry comprises a power controller that controls power distribution to components of the circuitry.

13. The device of claim 1 wherein the circuitry comprises a micro-controller that is configured to operate the device.

14. The device of claim 1 wherein the speaker has a frequency range that is approximately between 2 Kilo Hertz and 20000 Kilo Hertz.

15. The device of claim 1 wherein the circuitry is associated with memory that is configured to digitally store music.

16. The combination of a wind instrument and the device of claim 1, wherein a person properly holding the instrument can simulate playing of the instrument.

17. The combination of claim 16, wherein the wind instrument is a bugle.

* * * * *